US010787631B2

(12) United States Patent
Suchard

(10) Patent No.: US 10,787,631 B2
(45) Date of Patent: Sep. 29, 2020

(54) ON LINE CHEMICAL CLEANING OF AIR COOLERS

(71) Applicant: SENTRO Technologies USA, LLC, Irvine, CA (US)

(72) Inventor: Talmor Suchard, Irvine, CA (US)

(73) Assignee: SENTRO TECHNOLOGIES USA, LLC, Irvine, CA (US)

( * ) Notice: Subject to any disclaimer, the term of this patent is extended or adjusted under 35 U.S.C. 154(b) by 217 days.

(21) Appl. No.: 15/947,149

(22) Filed: Apr. 6, 2018

(65) Prior Publication Data

US 2018/0223226 A1 Aug. 9, 2018

Related U.S. Application Data

(63) Continuation of application No. 15/215,308, filed on Jul. 20, 2016, now abandoned.

(60) Provisional application No. 62/197,015, filed on Jul. 26, 2015.

(51) Int. Cl.

| | |
|---|---|
| ***C11D 3/04*** | (2006.01) |
| ***C11D 7/06*** | (2006.01) |
| ***C11D 7/12*** | (2006.01) |
| ***F28G 9/00*** | (2006.01) |
| ***B24C 1/08*** | (2006.01) |
| ***C11D 11/00*** | (2006.01) |
| ***F28G 1/16*** | (2006.01) |
| *F28B 1/06* | (2006.01) |

(52) U.S. Cl.

CPC ..... *C11D 7/06* (2013.01); *B24C 1/086* (2013.01); *C11D 7/12* (2013.01); *C11D 11/0041* (2013.01); *F28G 1/166* (2013.01); *F28G 9/00* (2013.01); *F28B 1/06* (2013.01)

(58) Field of Classification Search

CPC ..... C11D 17/0004; C11D 3/10
USPC ..... 510/233, 445, 509
See application file for complete search history.

(56) References Cited

U.S. PATENT DOCUMENTS

| | | | | |
|---|---|---|---|---|
| 3,715,314 A * | 2/1973 | Morgenstern | C11D 3/10 | 510/368 |
| 4,161,449 A * | 7/1979 | Smith | C11D 3/0031 | 252/8.91 |
| 5,783,537 A * | 7/1998 | Ahmed | C02F 3/342 | 510/191 |
| 8,771,622 B2 * | 7/2014 | Hughes | C01D 5/16 | 423/173 |

(Continued)

*Primary Examiner* — Gregory E Webb
(74) *Attorney, Agent, or Firm* — Pearl Cohen Zedek Latzer Baratz LLP

(57) ABSTRACT

The invention combines chemical cleaning with mechanical cleaning. In case of large scale facilities, the invention allows cleaning from bottom to top which obviates the need for special arrangements such as confined space entry scaffolding and safety nets removal in order to reach higher or inner parts. The dual effect of the combined mechanical and chemical cleaning facilitates a surprising efficient removal of organic and inorganic sediments. The chemical cleaning is achieved by a reaction of cleaning chemicals with the organic matter such as: oils, greases, hydrocarbons, cellulose. The implementation of the invention permits use of non-toxic, non-hazardous, environmental friendly mixture of sodium carbonate and sodium bicarbonate. Typical particle size of the thin powder used according to a preferred embodiment of the present invention shall be between 20-100 μm.

19 Claims, 7 Drawing Sheets

(56) References Cited

U.S. PATENT DOCUMENTS

| | | | | |
|---|---|---|---|---|
| 2012/0031350 | A1* | 2/2012 | Zhang | B24C 1/003 122/235.11 |
| 2013/0312794 | A1* | 11/2013 | Al-Otaibi | F28G 1/166 134/34 |
| 2017/0022460 | A1* | 1/2017 | Suchard | B24C 1/086 |
| 2017/0089651 | A1 | 3/2017 | Suchard | |

* cited by examiner

Example of spraying lance sizes

Example of spraying lance lengths

Example of spraying lance directions

Example of spraying lance dispersion

Example of spraying combination

ON LINE CHEMICAL CLEANING OF AIR COOLERS

CROSS-REFERENCE TO RELATED APPLICATIONS

This application is a continuation application of U.S. patent application Ser. No. 15/215,308, filed Jul. 20, 2016, which in turn claims the benefit of prior U.S. Provisional Patent Application No. 62/197,015, filed Jul. 26, 2015, both of which are incorporated by reference herein in their entirety.

FIELD OF THE INVENTION

The present invention relates to cleaning of deposits or scale or fouling and in particular, to cleaning of deposits or scale or fouling from complex structures where there are difficulties in reaching to their parts.

BACKGROUND

Equipment performance can deteriorate over time as result of accumulation of dust, mud, rust, microorganisms, oil, scale and other deposits. Heat exchangers can lose their thermal efficiency that may result inadequate and sometimes dangerous thermal conditions, higher energy consumption and bottlenecks in production.

The propensity of water or steam or other solvents to form solutions and emulsions is used in various cleaning processes. Many industrial processes rely on using water or steam or other solvents to dissolve and extract substances, sometimes with chemicals that are dissolved or solids that are suspended in water or steam or other solvents. Yet, there are some problems associated with the use of water or steam or other solvents. Apart from equipment mechanical or chemical damage, there is a global water crisis that has become a major concern with humanitarian implications. Additional environmental difficulties relate to treatment and disposal of waste water that had become costlier, as result of increasing environmental concern and governmental regulatory pressures. The capital intensive investments in the construction and the operation of large water infrastructures and wastewater treatment plants involve sometimes funding and technologies that are unavailable in some regions.

Existing methods for industrial cleaning of open equipment involve in washing with high pressure water or steam, use of soap or detergents or foam, dry-ice or various chemicals; however there are some problems that are associated with the usage of those techniques: impact on human health and the environment, a need to shut down equipment, special arrangements required to facilitate access to unreachable parts, possible damage to equipment caused by: thermal shocks, abrasion, erosion, chemical attack and other damages that remain after the treatment such corrosion, scale, stress cracks.

There is a long time need for a technique that will overcome the above mentioned disadvantages and negative impacts of the existing art.

SUMMARY

The present inventor has formed a way to avoid the shortcomings of the existing cleaning techniques by using waterless system allowing minimal shut down time, reduction equipment damage and environmental friendliness.

The present invention addresses a long time existing need for an efficient method for cleaning with minimum damage to equipment and infrastructure. The present invention is based on pneumatic spraying of dry thin powder. The system is designed to combine a chemical cleaning with a mechanical cleaning. In case of large scale facilities, the invention allows cleaning from bottom to top which obviates the need for special arrangements such as confined space entry, scaffolding and removal of safety nets in order to reach higher or internal parts. The synergetic effect of the combined mechanical and chemical cleaning facilitates an efficient removal of both organic and inorganic dirt. The chemical cleaning involves in a reaction of cleaning chemicals with the organic matter such as: oils, greases, hydrocarbons, cellulose. The mechanical cleaning involves a non-aggressive removal of inorganic matter such as dust, sand, mud and scale. Microorganisms are removed by chemical and mechanical cleaning.

The present inventor has found nontoxic, non-hazardous, environmental friendly usage of a mixture of sodium carbonate, sodium bicarbonate, sodium hydroxide and silicon dioxide (silica) achieves preferred results. Different ratios of those chemicals may be selected according to the specific structural material that should be cleaned and the conditions of which the cleaning process should be performed. For example, when there are structural materials that are sensitive to basic conditions, usage of sodium hydroxide shall be reduced or entirely eliminated. Using the above mentioned chemicals in thin powder form is to obviate the need to penetrate through finned tubes and clean residues after the treatment. In some rare cases of some small leftovers, their removal will involve only use of pressurized air to remove them.

DETAILED DESCRIPTION

Figure 1:
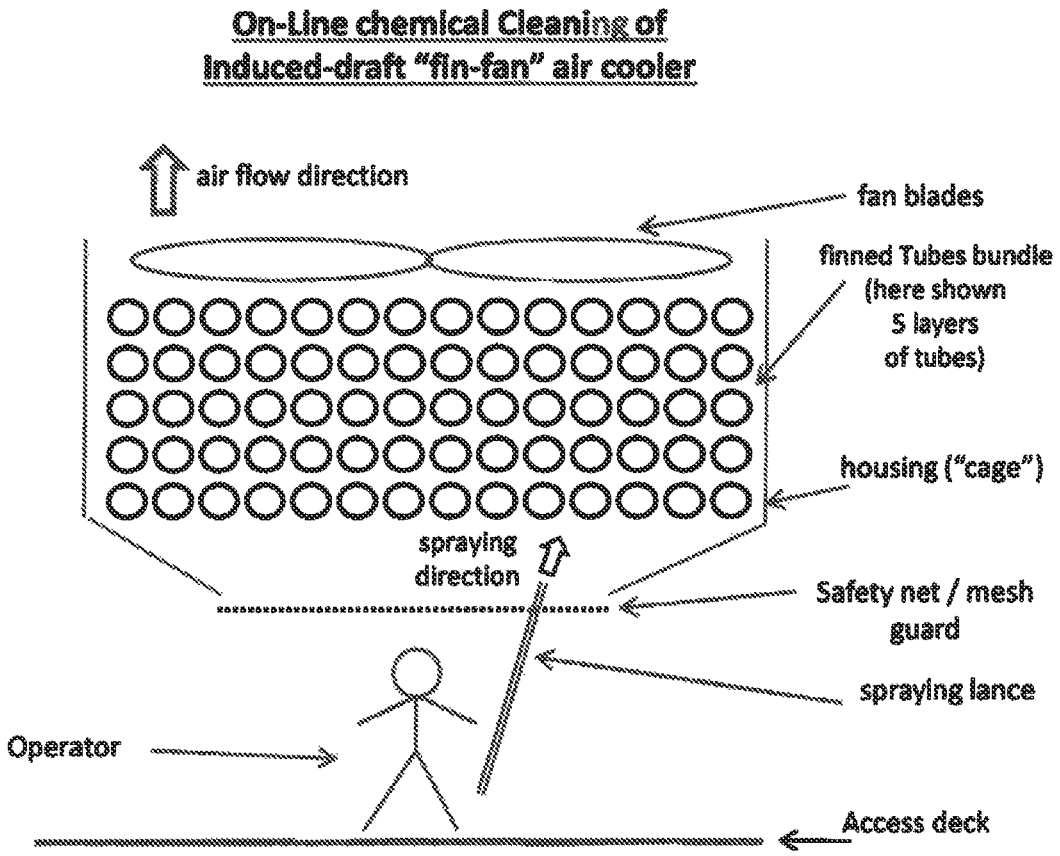
FIG. 1 is a schematic illustration showing some structural features according to an aspect of the present invention related to cleaning of Induced-Draft air cooler
Figure 2:
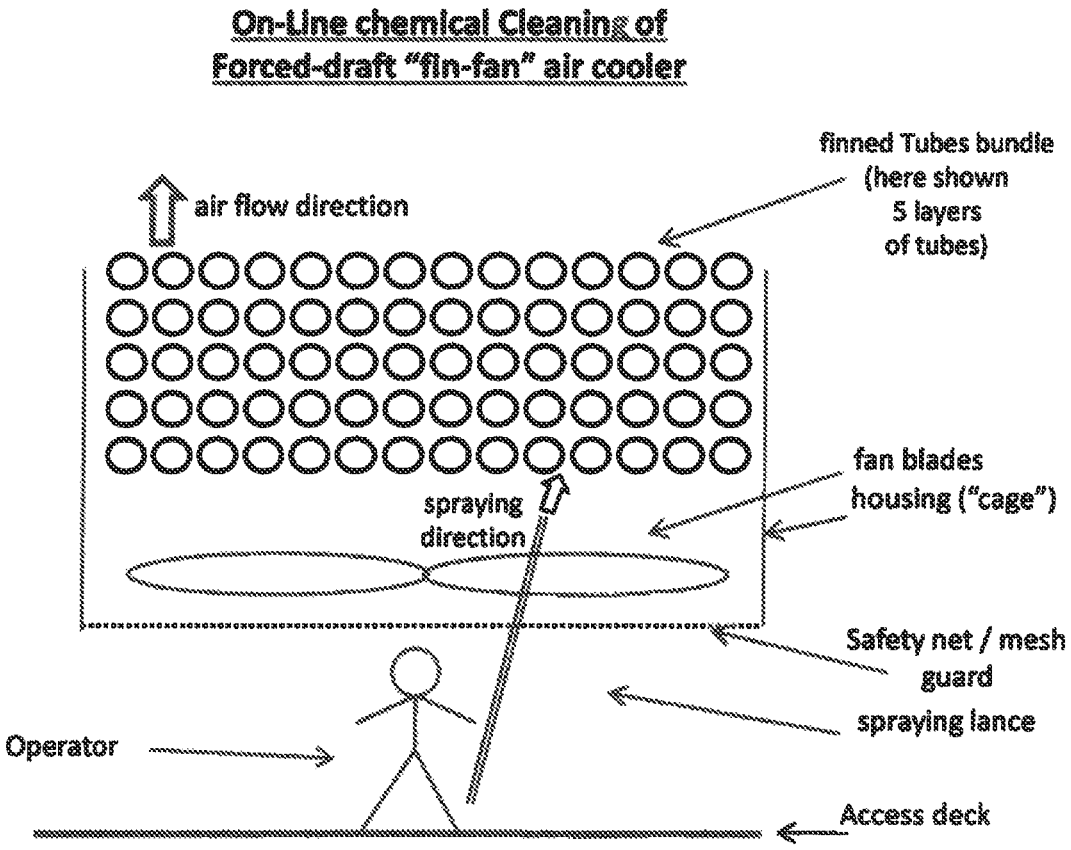
FIG. 2 is a schematic illustration showing some structural features according to an aspect of the present invention related to cleaning of Forced-Draft air cooler FIG. 3*a, b, c, d, e* are schematic illustrations showing some structural features according to an aspect of the present invention related to equipment used to spray the cleaning mixture
Figure 3:
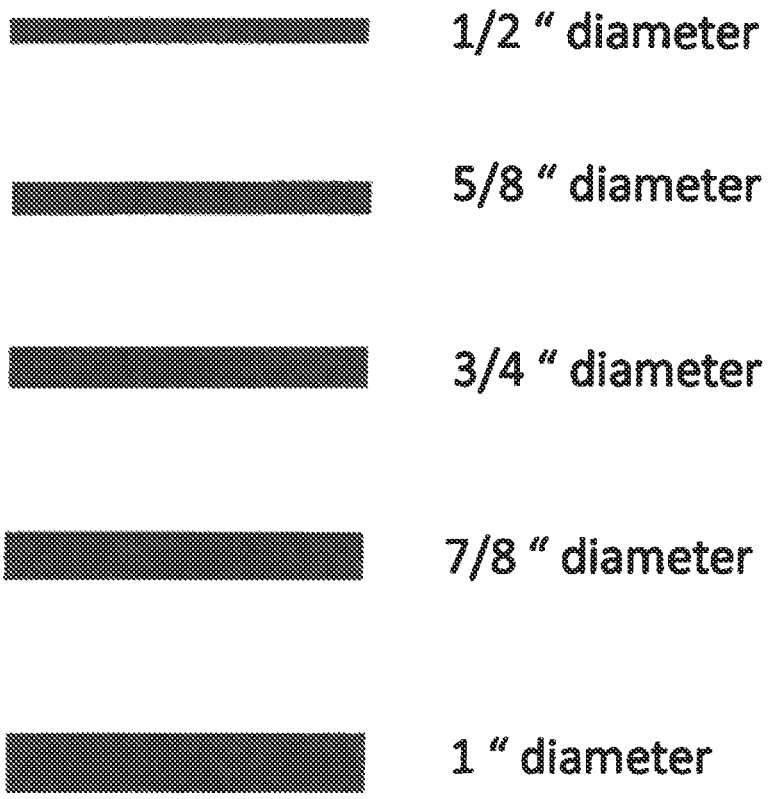
Figure 3:
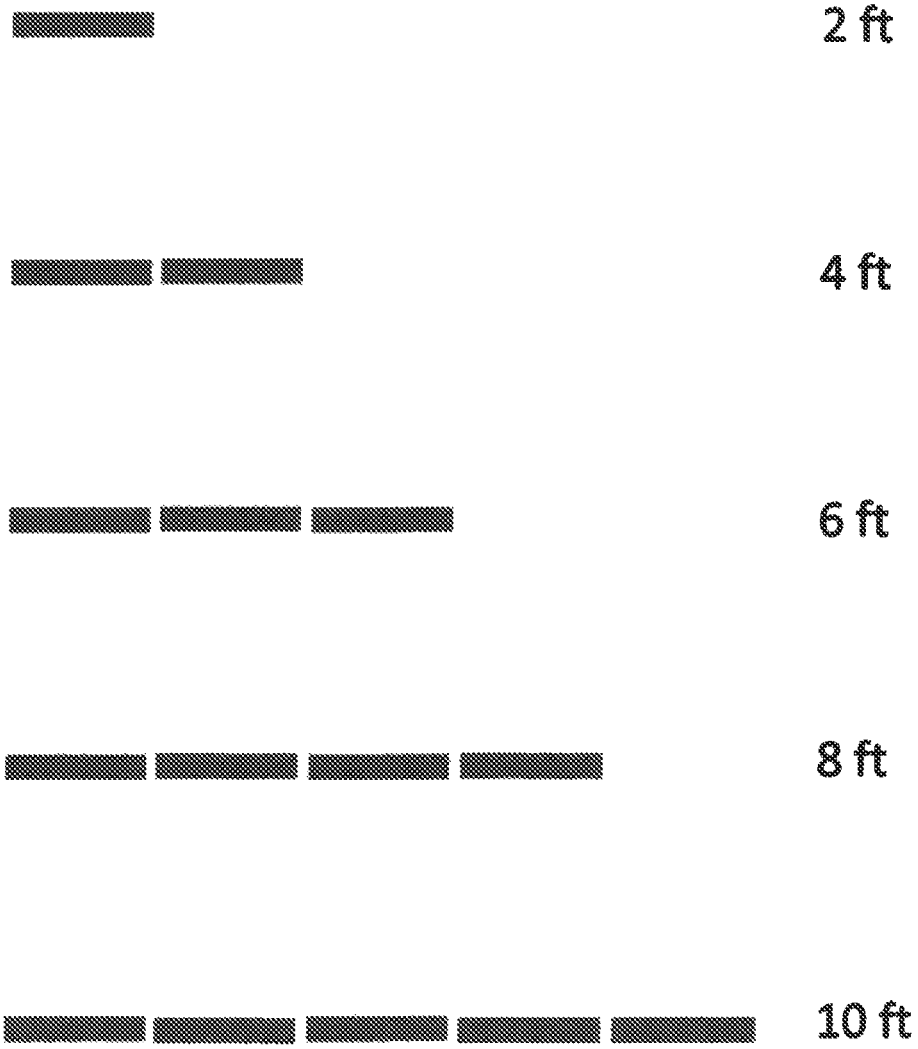
Figure 3:
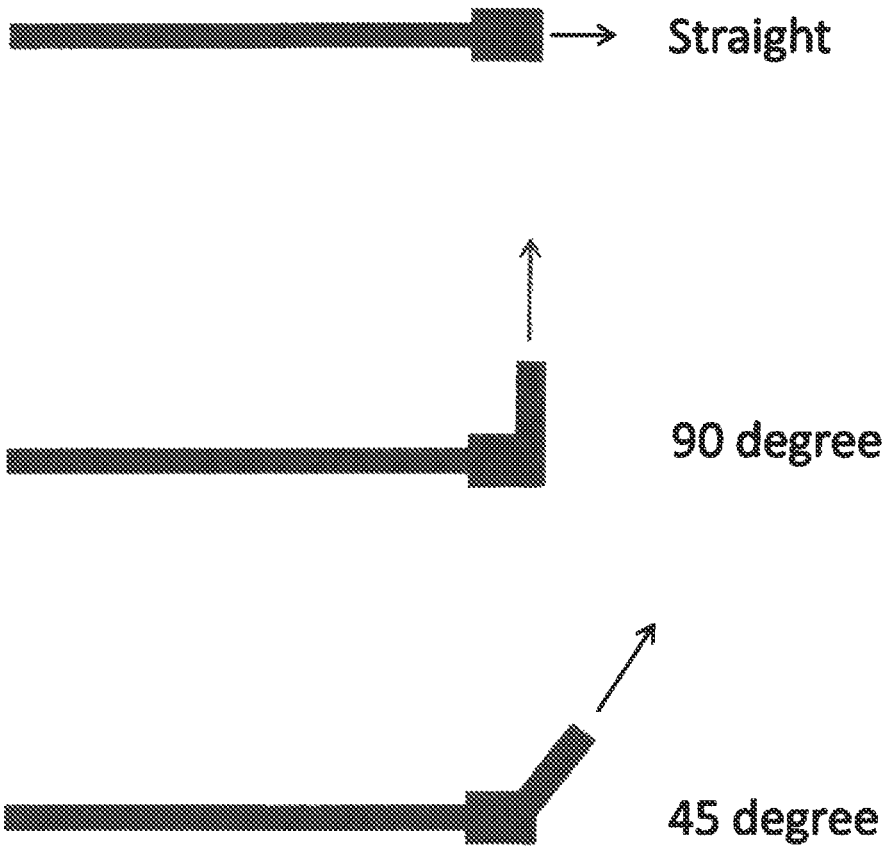
Figure 3:
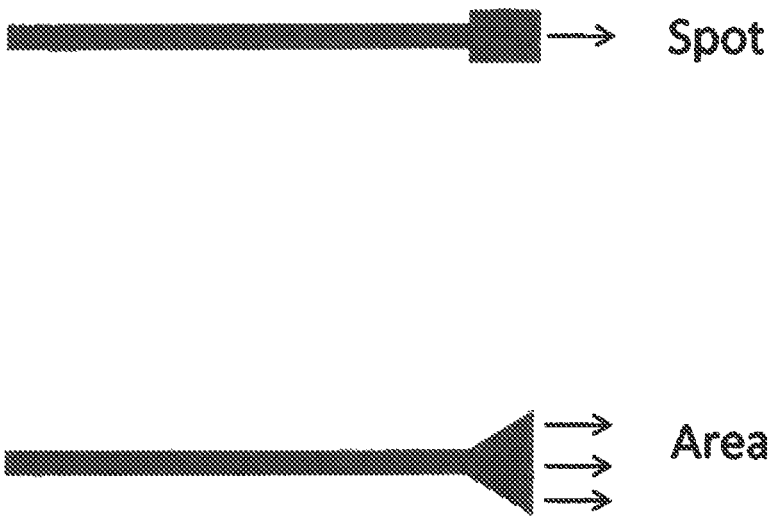
Figure 3:
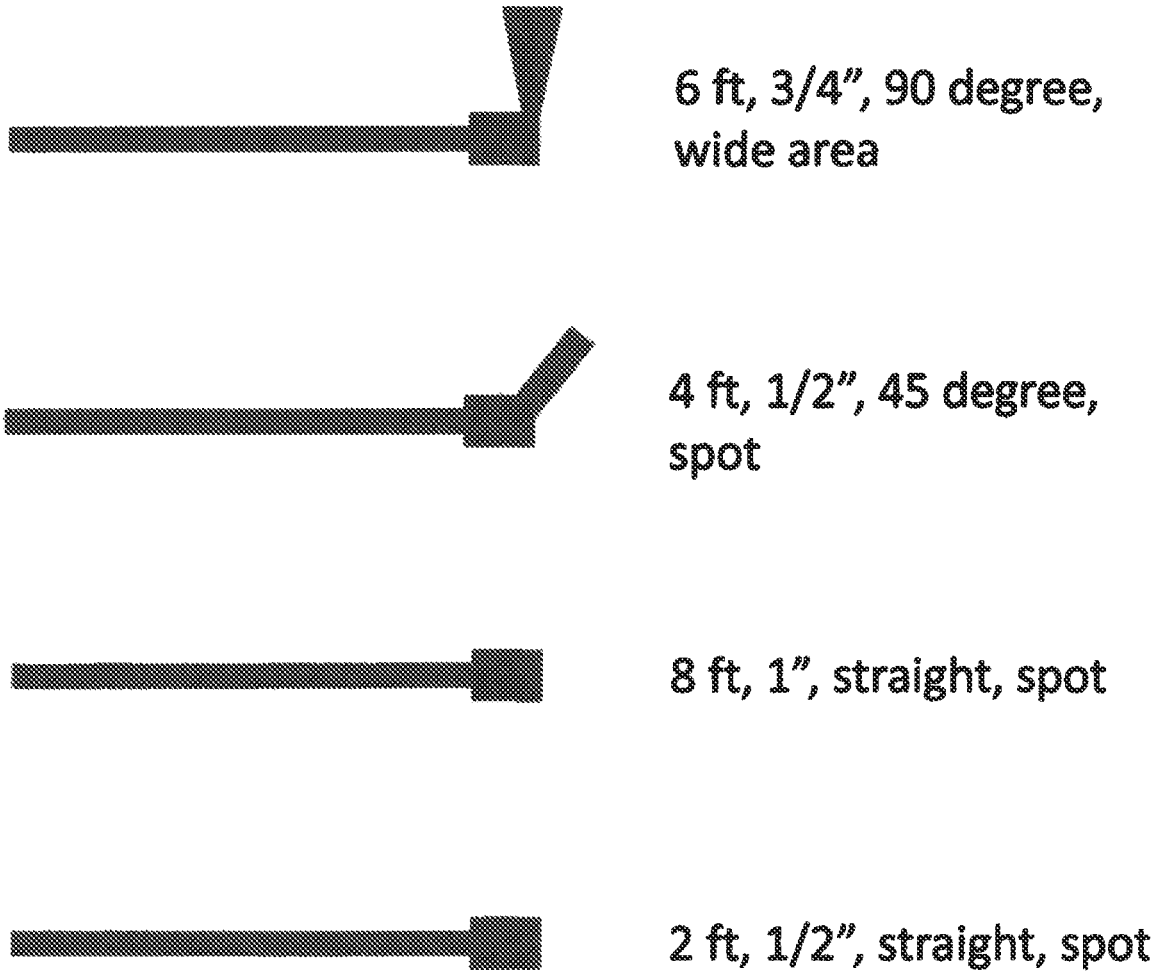

The present inventor has found a way to avoid the shortcomings of the existing cleaning techniques by using waterless cleaning of equipment parts that are difficult to reach while the present invention is based on pneumatic spraying of dry thin powder. The cleaning process is a combination of chemical and mechanical cleaning. For large scale structures, the invention allows cleaning from bottom to top with no need for special arrangements such as confined space entries, scaffolding and removal of safety nets that are usually applied for maintenance activities at heights. The synergistic effect of combination of mechanical and chemical cleaning facilitates surprising efficient removal of both organic and inorganic dirt. The chemical cleaning involves in reactions of chemicals with organic matter such as oils, greases, hydrocarbons, cellulose. The mechanical cleaning involves in a non-aggressive removal of inorganic matter such as dust, sand, mud and scale. Microorganisms are removed by chemical and mechanical cleaning. The present invention addresses a long time existing need for an efficient method of cleaning with minimum damage to equipment and infrastructure.

The present inventor has found that preferred results can be achieved using a mixture of sodium carbonate, sodium bicarbonate, sodium hydroxide and silicone dioxide (silica) which are nor toxic or hazardous and are environmentally friendly. Different ratios among those chemicals can be selected according to the structural material that need to be cleaned and the conditions in which cleaning should be performed. For example, when there are structural materials that are sensitive to basic conditions, usage of sodium hydroxide will be reduced or entirely eliminated.

Using sodium bicarbonate is intended to moderate basic conditions caused by the sodium carbonate and sodium hydroxide, however, when cleaning surfaces that are contaminated with acidic scale, the cleaning mixture will contain less sodium bicarbonate and more sodium carbonate and sodium hydroxide. Sodium carbonate and sodium hydroxide are more basic than sodium bicarbonate. In addition, those two substances decompose at higher temperatures compared to sodium bicarbonate, however usually the cleaning mixture will contain also sodium bicarbonate in order to moderate too extreme basic conditions. Usage of sodium bicarbonate is also intended to moderate possible hazardous conditions when using higher concentrations of sodium hydroxide.

In high ambient humidity such as in rainy areas, up to 20% silica are being added to the cleaning mixture, while in dry climates, small quantities of silica are added if at all. The addition of pure silica may assist to avoid clogs in the spraying equipment caused by interactions between the humidity and the other ingredients in the cleaning mixture. The inventor had found that adding silica that has a relatively high molecular weight, (compared to water for example) contributed to the efficiency of the cleaning process and the flow of the cleaning mixture toward different parts of dense structure that is under cleaning process. In some cases, a mixture of pure or close to pure sodium bicarbonate is used, especially when moderate basic conditions are required.

As opposed to existing techniques, thin powder used in accordance with the present invention usually eliminates the need to remove leftovers. In rare cases that some residues remain, a limited use of pressurized air will be sufficient. Particle size of the thin powder used according to a preferred embodiment of the present invention shall be between 20-100 μm.

The below explanations concerning using the present invention to clean air-cooled heat exchangers also known as "fin-fan" air coolers or "fin-fans" heat exchangers, will reveal a possible application embodying the principles of the present invention.

Air coolers or "fin-fans" can be found in oil refineries, petrochemical or chemical plants, power plants, geothermal plants, nuclear plants and etc. On-line chemical cleaning of air cooled heat exchangers is applicable for flat type or "pagoda" or "A" type air coolers, whether they are horizontal or vertical, forced draft or induced draft.

The fin fan heat exchanger is designed to reject heat to the surrounding from a fluid or a gas flowing in finned tubes which increase the surface area and the heat removal rate. There are two well established low cost techniques for heat removal, using water or air as the coolant. The disadvantage of using water is related to the need in constructing and maintaining infrastructure for transfer of the water from a reservoir to the heat exchanger and back to the reservoir, and the need to cool the water and treat them before recirculating them. In some cases, water can be in scarce and the reservoir can be remote. In addition, there is a need to treat the water with chemicals and with filtration, but in order to avoid accumulation of sediments and chemicals some of the water are excreted out, thus endanger the environment. The public awareness for water shortage and for the need to protect the environment is increasing and so, also difficulties, costs and regulations that are associated with treatment and disposal of wastewater. Using air-cooled heat exchangers minimizes those mentioned concerns. An air-cooled "fin-fan" heat exchanger can be as small as car radiator or large enough to cover several acres of land, as is the case on air coolers for large power plants. "Fin fans" are constructed of finned tubes that are arranged in bundles with very limited space between them. Typically, each bundle is constructed from 4 to 12 layers of finned tubes, the fins are usually made of aluminum or copper with high heat transfer coefficients. Over time, the thin fins and the gaps between tubes may accumulate dust, mud, sand, hardened calcium carbonate, organic materials like oil or polymers, and other deposits that significantly reduce the thermal efficiency of the heat exchanger, resulting higher process outlet temperatures; high energy consumptions and production bottlenecks.

Common existing techniques for cleaning fin fan bundles are: washing with high pressure water, using soaps, detergents or foam, dry-ice (which is solid CO2) or chemicals such as weak citric acid. For applying those techniques, long periods of equipment shutdowns are required, dealing with large quantities of residues after the cleaning and difficulties in reaching all parts of the heat exchanger, (such as elevated parts). In addition, the existing techniques cause damage to equipment some of which may be sensitive to water, for example heat exchanger control instruments, electric motors, etc.

The present invention is intended to overcome the above mentioned and further drawbacks of the existing art, as described in the below listing:

1. Combined mechanical and chemical cleaning: this dual effect allows that both organic and inorganic dirt will be removed. The chemical cleaning involves in reactions between the chemicals and the organic dirt such as oil, hydrocarbons, cellulose etc. The mechanical cleaning involves in a non-aggressive removal of inorganic dirt such as dust, sand, mud, calcium etc. The efficiency of the cleaning according to the present invention allows cleaning of 6-10 fan bundle sections a day.
2. On-Line cleaning: the cleaning is performed on-the-run, so there is no need to shut down the process equipment. There is no need to stop the production. In this way there are two benefits: maintaining the production rate and no need of equipment shutdown for cleaning. Cleaning can be performed at any time during the year and whenever there is an indication of lower thermal efficiency in the heat exchanger. In a preferred embodiment of the invention, cleaning will begin according to preset values of process parameters that indicate lower thermal efficiency.
3. Cleaning from bottom-to-top: there is no need to build scaffolding, no need to enter the fan housing, no need for confined space entry permits, no need to remove the guards or safety net.

In case of induced draft air coolers, where the fan is located above the tubes bundle and "pulls" air upwards, there is no need to stop the fan during the cleaning process. In case of forced draft air coolers, where the fan is located under the bundle and "pushes" air upwards, the fan shall stop for short period of time, usually 30-40 minutes, in order to spray the thin powder through the fan blades into the bundle.

4. Using thin powder: solids flow differently than liquids. Pressurized liquids or "dry ice" (solid CO2) streams when applied on a bundle of tubes are dispersed after the first or second layer of the tubes and may fail in penetrating into the bundle to deeper layers. Unlike this, the thin powder solids flow, according to the present invention penetrates between the fins and between the tubes through the whole bundle from one side to the other side, allowing the removal of all types of organic and inorganic dirt which are trapped inside the bundle between the fins and the tubes.
5. Waterless cleaning: the present invention involves in totally dry cleaning. No damage to fins due to mechanical impact of high pressurized streams of water or steam. No corrosion due to chlorides or weak acid or other chemicals that can be found in water. No need for cleanup sediments such as scale that may remain after washing with water. No waste water treatment. No water damage to electric motors or to control instruments.
6. No thermal shocks: As opposed to using "dry ice" there is no damage caused by thermal shocks (stress cracking). Using "dry ice" involves extremely low temperatures of −110° C. (−80° C.). Such low temperatures might for example cause damage to metal parts such as cast iron parts. Usage of "dry ice" requires heavy equipment and sometimes confined space entry permits which are not required according to the present invention.
7. No detergents: no damage to metal parts such as carbon steel parts due to basic conditions caused by detergents or soaps that are used in the existing art. Usage of caustic detergents cause to sediments left after the cleaning and a need to treat waste water containing those detergents.
8. No acids: no use of acids such as citric acid that attacks materials which are sensitive to low pH such as metals, especially aluminum or copper. Usage of acid requires wash after treatment followed by treatment of waste water with a low pH.

The cleaning a "fin-fan" heat exchanger, according to one aspect of the present invention comprises the below equipment:

Compressed air generator or connection to local compressed air supply.

Abrasive blasting machine.

Water separator ("moisture trap") or air dryer in the inlet of the blasting machine.

Blasting hoses for spraying the cleaning mixture. Such hoses can be of enforced rubber hoses.

Pneumatic control system to operate the blasting machine.

Spraying lances and tips.

In a preferred embodiment of the invention, compressed air is supplied in a minimum rate of 400 CFM at a range of 75 to 180 psi. Accordingly, the modified blasting machine operates under maximum pressure of 180 psi and the spraying hoses are rated for 180 psi.

Applying the present invention for cleaning of "fin-fan" air coolers facilitates an increase in the thermal efficiency of the heat exchanger, while reducing outlet process temperatures, lowering energy consumption increasing production rate and better environmental protection.

Hereunder few examples of using an aspect of the present invention for cleaning of "fin-fan" air coolers:

Example (1)

Cleaning of "fin-fan" air coolers in a refinery in Argentina that were contaminated by spills of acidic hydrocarbons, mostly light kerosene and naphtha which contain high percentage of sulfur. The sulfur, together with water vapor from the air, creates sulfuric acid which is very corrosive. A mixture which contained 60% Sodium Carbonate, 20% sodium hydroxide and 20% sodium bicarbonate was used in order to simultaneously clean and neutralize the acidic contamination.

Example (2)

Cleaning of "fin-fan" air coolers in a petrochemical plant in Canada. The air coolers were contaminated with dust, mud and sand, which are mostly chemically inert components. A mixture which contained 90% sodium bicarbonate and 10% sodium carbonate, because there was no need to neutralize acidity.

Example (3)

Cleaning of "fin-fan" air coolers in a chemical plant for production of Ammonia in Texas where the air coolers were contaminated with some unspecified acidic material in a very humid tropical environment. The cleaning mixture contained 40% Sodium Carbonate, 50% Sodium Bicarbonate and 10% of silica. This mixture allowed free flowing of strong alkali stream to neutralize the acidic material. Also, an air-dryer and a water separator were in use, located between the air compressor and the blasting machine, due to the high humidity.

The invention claimed is:

1. A waterless mixture for cleaning deposits, said mixture comprising sodium carbonate, sodium hydroxide and sodium bicarbonate.

2. A mixture according to claim 1, comprising 80% sodium bicarbonate and 20% sodium carbonate.

3. The mixture of claim 1, further comprising silicon dioxide.

4. The mixture of claim 3 comprising up to 20% silicon dioxide.

5. The mixture according to claim 1 comprising 60% Sodium Carbonate, 20% sodium hydroxide, and 20% sodium bicarbonate.

6. A mixture according to claim 3 comprising 40% Sodium Carbonate, 40% Sodium Bicarbonate and 20% of silicon dioxide.

7. The mixture of claim 1, wherein said mixture particle size is less than 200 μm.

8. The mixture of claim 7, wherein said particle size is 10-100 μm.

9. A method for cleaning deposits, said method comprising creating a chemical reaction by combining said mixture of claim 1 with said deposits.

10. The method of claim 9, wherein said deposits comprise microorganisms.

11. The method according to claim 9, wherein said chemical reaction comprises reacting of chemicals with an organic matter.

12. The method according to claim 9, further comprising mechanical cleaning.

13. The method of claim 9, wherein said deposits are inside a heat exchanger.

14. The method of claim 9, wherein said method comprises spraying said mixture.

15. The method of claim 14, wherein said spraying is spot or area.

16. The method of claim 9, wherein said mixture comprises particle size of less than 200 μm.

17. The method of claim 9, wherein said mixture comprises particle size of 10-100 μm.

18. A system for cleaning deposits or fouling by spraying a waterless mixture according to claim 1, wherein said system comprises a sprayer and a lance connected with said sprayer.

19. The system of claim 18, wherein said sprayer comprises a tip, wherein said tip selected from the group consisting of: ¾" 90 degree wide area, ½" 45 degree, and 1" straight spot.

* * * * *